US008829427B2

(12) United States Patent
Brouard et al.

(10) Patent No.: US 8,829,427 B2
(45) Date of Patent: Sep. 9, 2014

(54) CHARGED PARTICLE SPECTRUM ANALYSIS APPARATUS

(75) Inventors: Mark Brouard, Oxford (GB); Claire Vallance, Oxford (GB); Andrei Nomerotski, Oxford (GB)

(73) Assignee: Isis Innovation Limited, Oxfordshire (GB)

( * ) Notice: Subject to any disclaimer, the term of this patent is extended or adjusted under 35 U.S.C. 154(b) by 0 days.

(21) Appl. No.: 13/811,117

(22) PCT Filed: Jul. 20, 2011

(86) PCT No.: PCT/GB2011/051374
§ 371 (c)(1), (2), (4) Date: Mar. 13, 2013

(87) PCT Pub. No.: WO2012/010894
PCT Pub. Date: Jan. 26, 2012

(65) Prior Publication Data

US 2013/0187041 A1 Jul. 25, 2013

(30) Foreign Application Priority Data

Jul. 20, 2010 (GB) ..... 1012170.5

(51) Int. Cl.

| | |
|---|---|
| ***H01J 49/00*** | (2006.01) |
| ***H01J 49/34*** | (2006.01) |
| ***H01J 49/40*** | (2006.01) |
| ***H01J 49/06*** | (2006.01) |

(52) U.S. Cl.
CPC ..... *H01J 49/403* (2013.01); *H01J 49/34* (2013.01); *H01J 49/0031* (2013.01); *H01J 49/0004* (2013.01); *H01J 49/40* (2013.01); *H01J 49/061* (2013.01)
USPC ..... 250/282; 250/281

(58) Field of Classification Search
CPC ..... H01J 49/0004; H01J 49/061
USPC ..... 250/281, 282
See application file for complete search history.

(56) References Cited

U.S. PATENT DOCUMENTS

2009/0272890 A1* 11/2009 Ogawa et al. ..... 250/281

FOREIGN PATENT DOCUMENTS

JP 05174783 A * 7/1993 ..... H01J 49/34

* cited by examiner

*Primary Examiner* — Michael Maskell
(74) *Attorney, Agent, or Firm* — Smith Moore Leatherwood LLP; Kimberly B. Gatling

(57) ABSTRACT

A charged particle spectrum analysis apparatus comprising an electric field generator arranged to subject charged particles to a time-varying electric field, a detector to record charged particle time spectrum data of charged particles which have passed through the electric field, the detector comprising a position-sensitive detection portion, and the time-varying electric field arranged to be activated in synchrony with activation of detector, and the time-varying electric field arranged to subject a predetermined region of said detection portion to consecutive charged particle deflection cycles.

14 Claims, 5 Drawing Sheets

CHARGED PARTICLE SPECTRUM ANALYSIS APPARATUS

This application is a national stage application under 35 U.S.C. §371 of International Application No. PCT/GB2011/051374 filed 20 Jul. 2011, which claims priority to Great Britain Application No. GB 1 012 170.5 filed 20 Jul. 2010, the disclosures of which are expressly incorporated herein by reference.

TECHNICAL FIELD

The present invention relates to charged particle spectrum analysis apparatus, and in particular, although not exclusively, to time-of-flight mass spectrometers.

BACKGROUND

In time-of-flight mass spectrometry, ions produced from a sample are accelerated by an electric field along a flight path in a pulsed fashion. The field provides each ion with the same kinetic energy. Since kinetic energy is related to mass and velocity by $K=\frac{1}{2}mv^2$, the velocity of a given ion, and therefore its arrival time at the detector (positioned at the far end of the flight tube), depends on its mass to charge ratio m/z according to the following relationship.

$$t = d\sqrt{\frac{m}{2zV}}$$

where d is the length of the flight tube and V is the acceleration potential. The mass resolution of a time-of-flight mass spectrometer is therefore directly determined by the time resolution of the detection system. An alternative method for generation of sample ions involves using a neutral sample within a DC field and to effect ionization using a laser (or other means). The sample molecules do not 'see' the extraction field until they are ionized. Microchannel plates (MCPs) are usually used to detect the ions. MCPs are thin glass plates laser-drilled with an array of holes. The plates are resistively coated, such that an ion striking the front of a channel elicits the emission of electrons from the surface. When an appropriate potential difference is applied across the plate, the electrons are accelerated through the channel, producing more electrons on every collision with the channel surface. For each ion striking the front of a channel, up to $10^3$ electrons are emitted from the back face. Typically, two or three MCPs are stacked together to increase the gain to $10^6$ or higher. In most time-of-flight experiments (and in all commercial mass spectrometers), the total electron current produced by the MCPs is measured.

Currently employed detection techniques are limited in their time (and therefore mass) resolution primarily by the time resolution of the readout electrons used to read a time-dependent signal from the MCP's.

We seek to provide an improved charged particle spectrum analysis apparatus, and in particular an improved time-of-flight mass spectrometer.

SUMMARY

According to a first aspect of the invention there is provided a charged particle spectrum analysis apparatus comprising an electric field generator arranged to subject charged particles to a time-varying electric field, a detector to record charged particle time spectrum data of charged particles which have passed through the electric field, the detector comprising a position-sensitive detection portion, and the time-varying electric field arranged to be activated in synchrony with activation of detector, and the time-varying electric field arranged to subject a predetermined region of said detection portion to consecutive charged particle deflection cycles.

According to a second aspect of the invention there is provided a method of charged particle spectrum analysis comprising subjecting charged particles to a time-varying electric field, and activating a detector to record charged particle time spectrum data of the charged particles which have passed through the field, and activating the time-varying electric field in synchrony with the detector, the detector comprising a position-sensitive detection portion, and arranging the time-varying electric field to subject a predetermined region of said detection portion to consecutive charged particle deflection cycles.

BRIEF DESCRIPTION OF THE DRAWINGS

Various embodiments of the invention will now be described, by way of example only, with reference to the following drawings in which.

DETAILED DESCRIPTION

Below are described two embodiments of charged particle spectrum analysis apparatus. The first in which the electrons emitted from the back of the microchannel plate detector are streaked, and the second in which the sample ions are streaked as they travel along the flight tube. Both embodiments require that the ion beam takes the form of either a well-defined spot or, if the potential for parallelised detection is to be exploited, a sheet. This may be achieved either by passing the sample ion beam through an appropriate aperture or slit or by focusing the ions into a ribbon or sheet beam using electric or magnetic fields.

Figure 1:
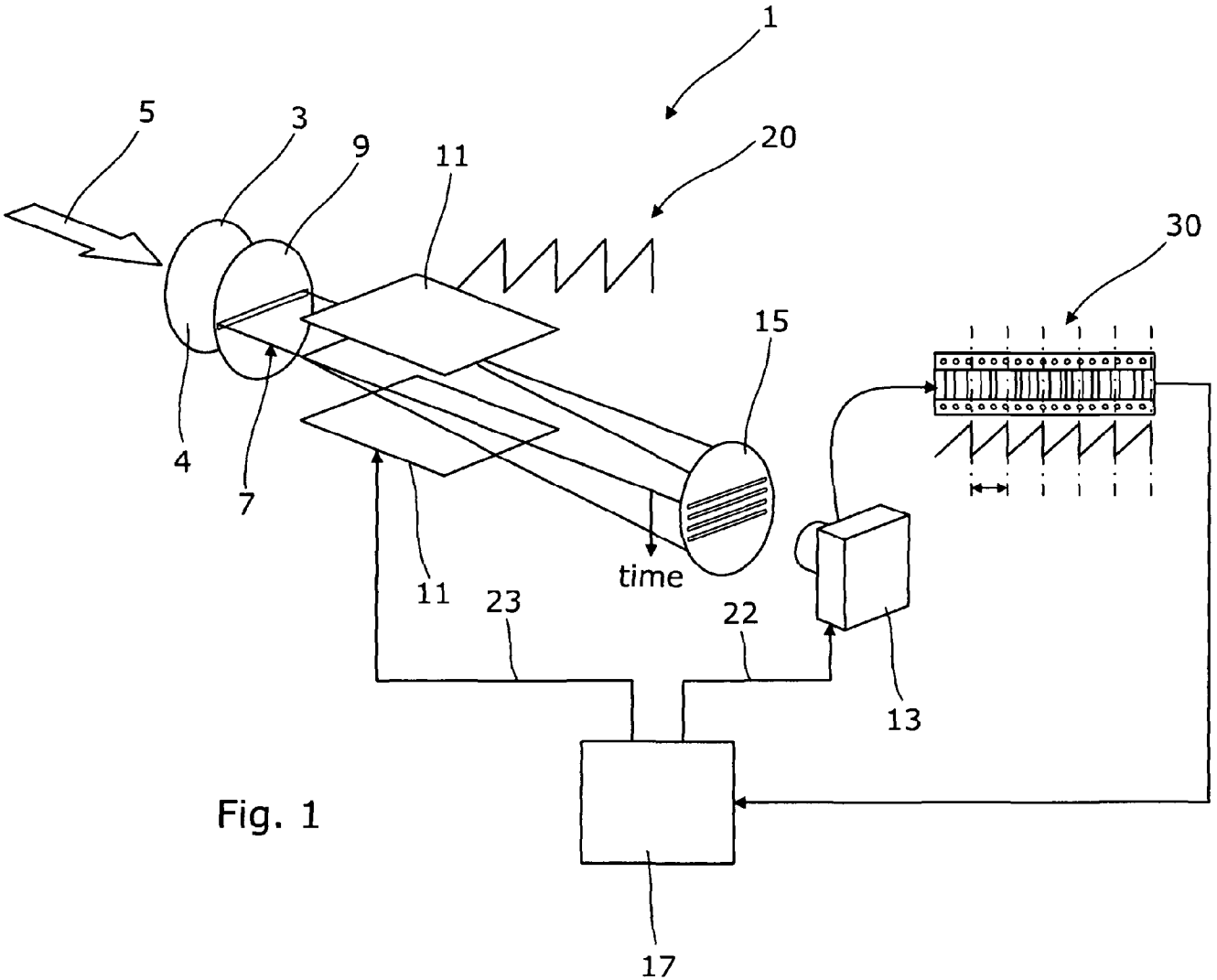
FIG. 1 shows a charged particle spectrum analysis apparatus.

Referring to FIG. 1 there is shown a charged particle spectrum analysis apparatus 1. In overview, a first set of Micro Channel Plates (MCPs) 3 convert sample ions 5 into an amplified beam of electrons 7. The beam of electrons 7 is collimated by a slit 9 placed behind the MCPs 3. Electrons emitted from the back face of the channel plates are accelerated through the slit 9 and subjected to a ramped deflection pulse by two parallel deflection plates 11, the ramped deflection pulse substantially synchronised with the frame rate of a camera 13 (or other image recorder) which records images which are displayed on a rear face of a position sensitive charged particle detection portion 15. The camera 13 and the detection portion 15 form a detector of the apparatus which is arranged to record charged particle time spectrum data. The electric field generated by the deflection plates is achieved by way of a time varying voltage applied across the plates 11. Additional lenses may be located behind the first set of MCP's to focus the ion beam into the region between the deflection plates. The slit may be positioned in front of or behind the first set of MCP's.

The detection portion 15 comprises an MCP-phosphor combination, comprising at least one MCP and a phosphor screen. Each electron striking the MCP elicits a cascade of electrons through one of the channels, and the pulse of electrons leaving a back face of the MCP is accelerated towards the phosphor screen, producing a pulse of light. It will be appreciated that if no further gain is required this could be replaced by a simple phosphor screen. In this way the distribution of electrons striking the detector is transformed into an image on the phosphor screen, and the image can then be captured by the camera 13. It will be appreciated that in alternative embodiments the detector may comprise another type of position-sensitive particle sensor, such as a phosphor or CMOS-based particle sensor.

The camera 13 comprises an image sensor which may comprise Charge Coupled Device (CCD) or Complimentary Metal Oxide Semiconductor (CMOS) technologies. The image sensor is a fast image sensor capable of repeatedly capturing frames with a high repetition rate which is synchronised with the electric field. The camera could be a framing camera in which the frame rate is synchronised with the time-varying electric field. Alternatively, the camera may comprise a CMOS-based 'event counting' sensor in which the clock rate of the sensor is synchronised with the time-varying electric field. In one of several approaches multiple images are recorded over the timescale of the time-of-flight mass spectrum, typically spanning up to hundreds of microseconds. In one embodiment of the imaging sensor of the event-counting type, rather than recording full image frames during each exposure, the sensor will record the position and arrival time of each ion as it reaches the detector, yielding considerable savings on data storage and handling (the total number of data points that will need to be read out from the sensor will be equal to the number of ions detected rather than to the total number of pixels in all of the recorded frames).

It will be appreciated that both the CCD and CMOS devices are sensitive to both visible light and to charged particles, and so may be used in what could be termed a direct detection mode in which the electrons are detected directly by the imaging sensor, rather than being converted into an optical signal by impinging on a phosphor screen. In this mode, time resolution can be increased as compared to use of imaging on a phosphor screen.

Figure 2:
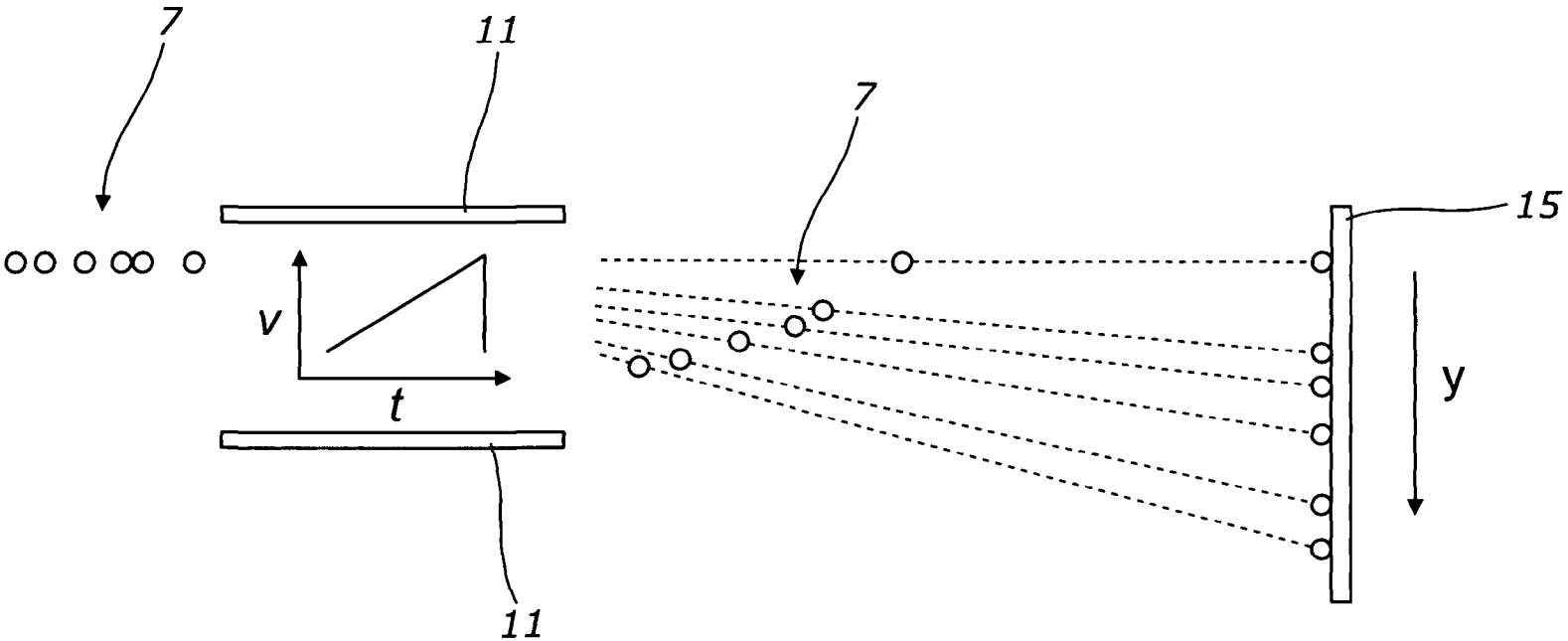
FIG. 2 shows a schematic side view of part of the apparatus of FIG. 1.

It is straightforward to show that for electrons accelerated through a potential V, the potential $V_{def}$ required to cause a deflection d over a path length L is $$V_{def} = 2\frac{xd}{zL}V$$

where z and x are the length and separation of the deflection plates, respectively. As shown in FIG. 2, electrons arriving early in the ramp cycle suffer little deflection, while those arriving later in the voltage ramp undergo a much greater deflection. This has the effect that electrons formed at the MCP's from ions of different masses (and therefore different arrival times) are distributed, or streaked, in a direction y which is substantially parallel to a dimension of the detection portion 15.

The ramped deflection potential is shown at 20 in FIG. 1, and is of the form of a cycle of linear increases in potential to a predetermined maximum, producing a sawtooth profile.

The image at the phosphor screen is recorded by the imaging sensor of the camera 13, and the frequency of the ramp potential is synchronised with the frame rate of the camera, such that ions sampled within a single sweep are recorded in a single frame. Each sweep, corresponding to what may be termed a deflection cycle, is directed onto the same predetermined region of the detector, in a consecutive repeating manner. Each sweep progressively deflects particles across the predetermined region (for example from top to bottom, or vice versa, or from one side to the other, of the predetermined region) The synchronisation between the imaging sensor and the ramped potential is achieved by way of a controller 17 which comprises a data processor and a memory. The memory containing instructions to cause the data processor to output synchronised, or phased, control signals 22 and 23 to the camera 13 and to a voltage generator for the deflection plates 11, respectively.

As is schematically shown at 30, the frequency of the control signal 23 is such that each ramped cycle is substantially temporally co-terminus with the frame rate of the camera 13 such that ions sampled within a single sweep (ie one cycle of the time-varying electric field) are recorded in a single frame.

Figures 3, 4, 5:
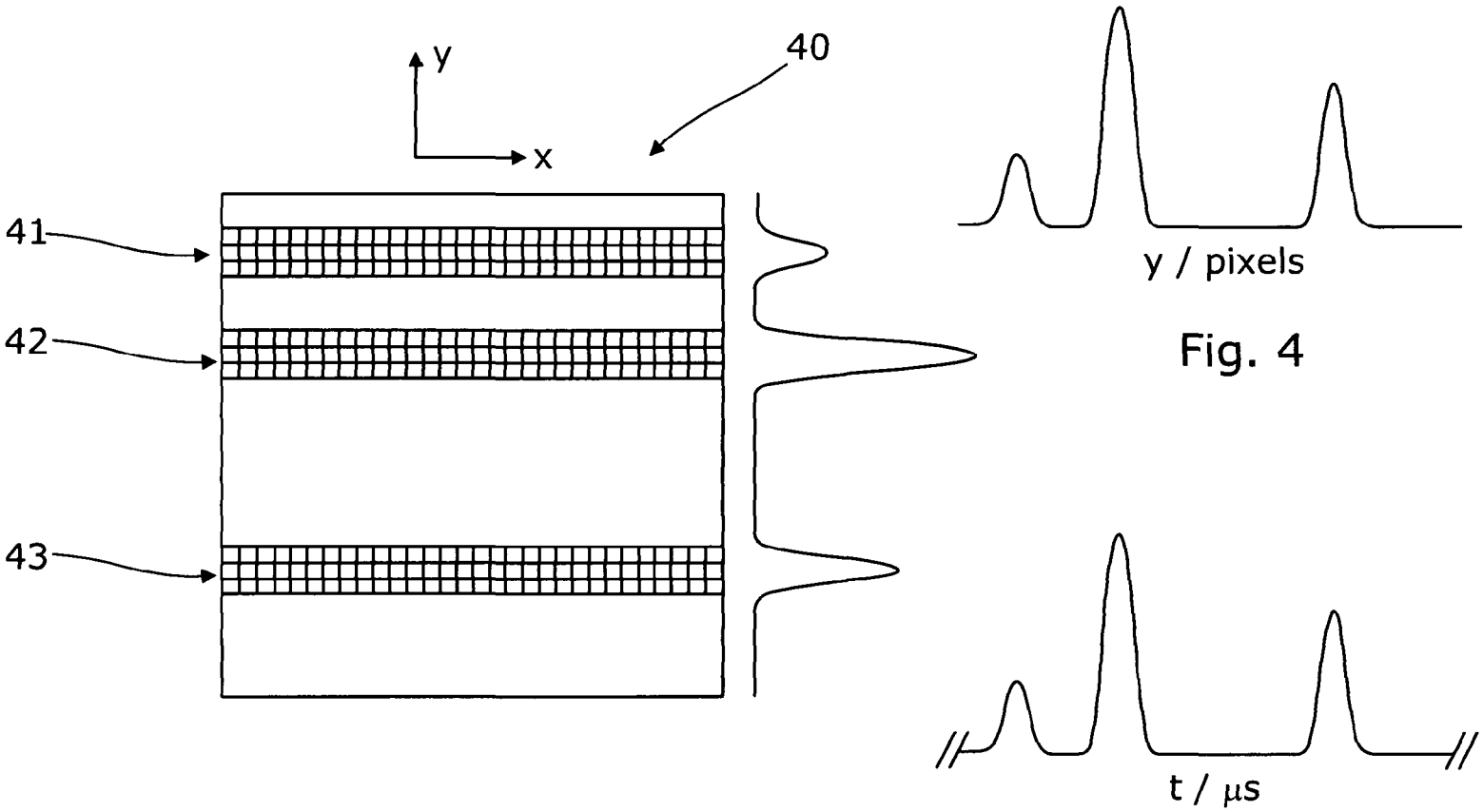
FIG. 3 shows an image of a distribution of charged particles.
FIGS. 4 and 5 show graphical representations of the image shown in FIG. 3.

Data processing of the TOF mass spectra from the images is performed by the controller 17 and will now be described. FIG. 3 shows a resulting image displayed on the phosphor screen 15, and captured by the camera 13. It will be appreciated that FIG. 3 shows a single frame 40 from the complete sequence of consecutive frames that would be acquired in order to measure a complete mass spectrum. The 'x' direction contains information on the position at which the electron passed through the slit 9, while the 'y' direction contains information on its arrival time. In the following analysis it is assumed that the ions have simply been spread out along the 'x' dimension in order to exploit the parallel detection capabilities of a pixel detector, and that it is not necessary to retain any information in this coordinate. Each horizontal line 41, 42 and 43 on the image 40 corresponds to ions of a particular mass, with the signal intensity along the horizontal (x) axis simply reflecting the extent of the slit in the streaking ion optics.

In the following, we denote the signal at a particular pixel position $(x_i,y_j)$, where i and j are the pixel indices (both running from 0 to 511 for an exemplary 512×512 pixel sensor), as $S(x_i,y_j)$. The first step in the data analysis is to sum over the position (x) axis to obtain the total signal arriving at the detector as a function of the position along the vertical (y) axis. The signal $S(y_n)$ at a particular vertical position $y_n$ is $$S(yn) = \sum_{i=0}^{511} S(xi, yn)$$

The integrated signal is shown to the right of the image 40 in FIG. 3, and in FIG. 4. We now have 'time' as a function of pixel number along the y axis. This needs to be transformed into a true time by taking account of the frame number N and the vertical or 'y' position within each frame. For the Nth frame in the acquisition for a given TOF cycle, the transformation from y (in pixels) to time of flight t (in seconds or microseconds) will take the form $$t=(N-1)T_{clock}+f(y)$$

Here, the first term determines the 'start' time of the frame. Each frame is synchronised to the clock cycle of the image sensor of the camera 13, so the total time that has elapsed up to the start of the frame is simply the number of clock cycles elapsed so far, N−1, multiplied by the clock period $T_{clock}$. The detailed form of the second term, which converts from y position to time within the frame of interest, will depend on the details of the sweep pulse, specifically its time variation and amplitude, as well as on the distance the swept electrons travel between the slit and detector, and the acceleration potential between the slit and detector. An 'instrument resolution function' correction to correct for imperfect collimation of the swept electrons or ions and/or any non-linearities in the experimental timing or extraction potentials could also be performed. The resulting form of the time varying signal is shown in FIG. 5.

Once this transformation has been conducted, the data is in the same form as obtained from a conventional time-of-flight measurement, and may be converted to a mass spectrum and analysed using standard techniques.

The above analysis has ignored any spatial information encoded in the x axis of the images. However, by employing appropriate velocity or spatial mapping ion optics, the apparatus could be configured such that the x coordinate contains one dimension of information on the position or velocity of the sample ions at their point of formation. In order to retain this information during the data processing, one would simply omit the summation over the x axis of the detector and carry out the transformation of the y axis from position (in pixels) to time-of-flight or ion mass. An appropriate transformation would also have to be carried out on the x axis to convert from ion arrival position (in pixels) to the corresponding position or velocity relevant to the ions at their point of formation.

Figure 6:
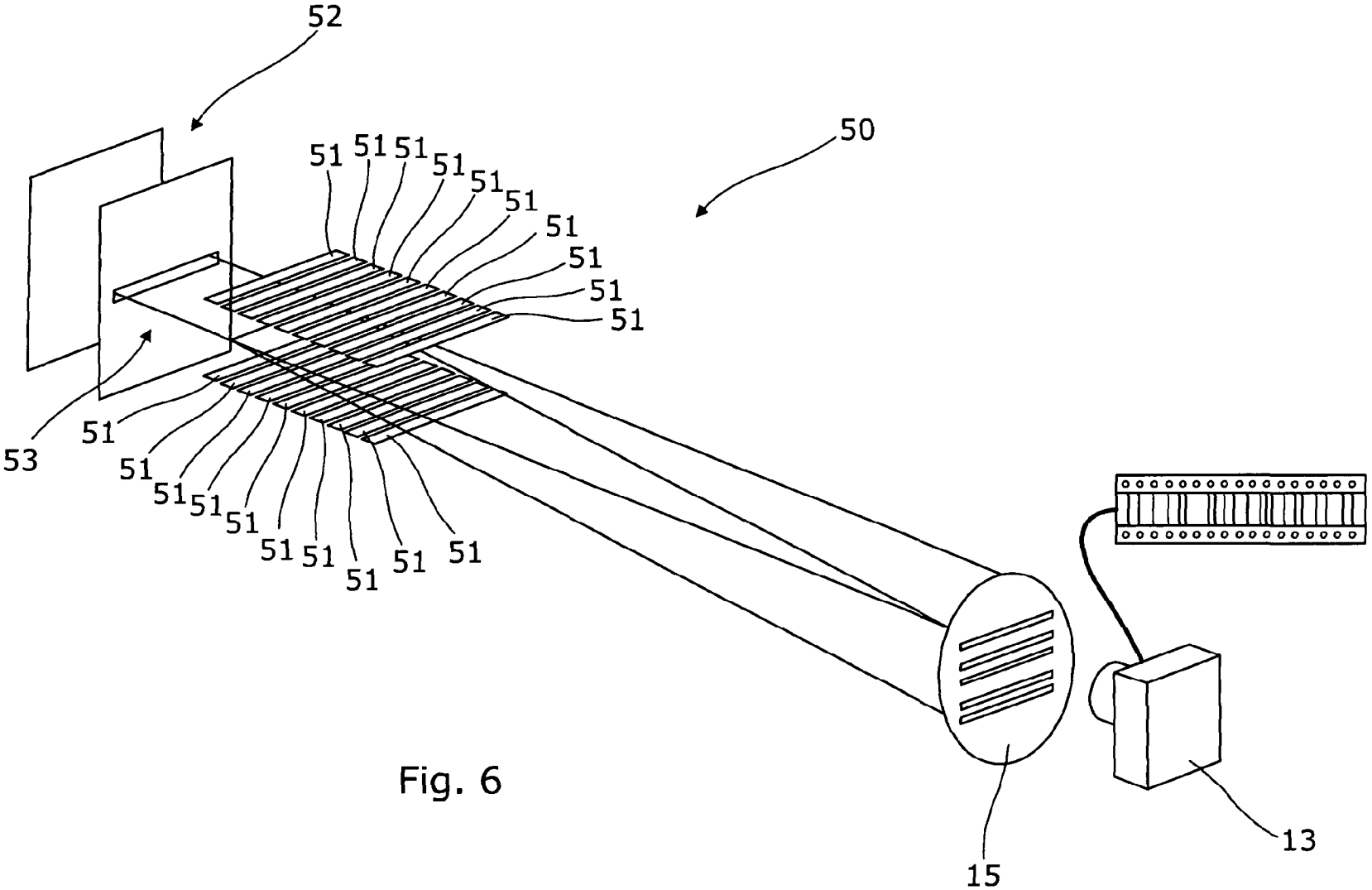
FIG. 6 shows a second embodiment of a charged particle spectrum analysis apparatus.

One advantage of particular importance of the apparatus 1 is that extremely high time resolutions are achievable. A greater time resolution corresponds to an improved ability to resolve different masses. The time resolution is determined by the clock cycle of the imaging sensor of the camera 13 and by the number of pixels over which the ion or electron signal is distributed. For example, a conservative estimate for the length of a clock cycle is 50 ns. If the ion/electron signal is swept over 512 pixels, this gives a time resolution of $(50\times10^{-9})/512=9.77\times10^{-11}$ s=97.7 ps. Further gains in the time resolution are achievable by reducing the length of a clock cycle and/or by increasing the number of pixels in the sensor. The above calculation assumes that one ion arriving at the detector illuminates one pixel on the image sensor. If multiple pixels are illuminated then the time resolution is degraded somewhat. However, this effect may be partly compensated for by de-convoluting an 'instrument resolution function' from the images. In the case that the ions or electrons are focussed into a spot, an advantage is that a full 512×512 array of pixels could be used to improve the time resolution. This would require the focussed spot to be deflected across the detector in a zig-zag two-dimensional streak or raster (rather like that used in an old television), rather than a one dimensional linear streak shown in FIGS. 1, 2 and 6. Although such a 2D streak would be more difficult to achieve, there is the potential for further considerable gains in time resolution, without loss of throughput. The trade-off would be that one would necessarily lose the velocity or spatial information potentially encoded in the x-coordinate.

The total recording time per TOF cycle is determined by the memory allocated to the counters in each pixel. For example, assuming that the sensor is equipped with 12 bit counters, this gives a total recording time equal to $2^{12}$ times the length of a clock cycle, which comes to around 200 μs for a 50 ns clock period. This is a relatively straightforward parameter to adjust by changing the specifications of the image sensor chip. This, therefore, results in the advantage of a (relatively) long recording period, combined with high time (and therefore) mass resolution.

A further advantage of the apparatus 1 is that significantly improved ion throughputs can be achieved. The ion throughput, defined as the total number of ions that can be recorded per second, is determined by the number of ions that can be recorded per time-of-flight cycle (a function of the detector size), and the repetition rate (number of cycles per second) at which the sensor can be run.

Using the example of a sensor containing 512×512 pixels, and in which each pixel can detect multiple ions per TOF cycle. Detection of multiple ions per TOF cycle is achieved by way of generating a timestamp each time a pixel is triggered by the arrival of an ion. So, in this example the total number of ions N that can in principle be detected per cycle is $$N=512\times512\times4=1048576$$

Recording for 200 μs per cycle corresponds to a repetition rate R of $1/(200\times10^{-6})$, or 5000 Hz. The maximum possible total ion throughput T is therefore $$T=NR=(1048576)\times(5000)=5.24\times10^{9}\text{ ions s}^{-1}.$$

Figure 7:
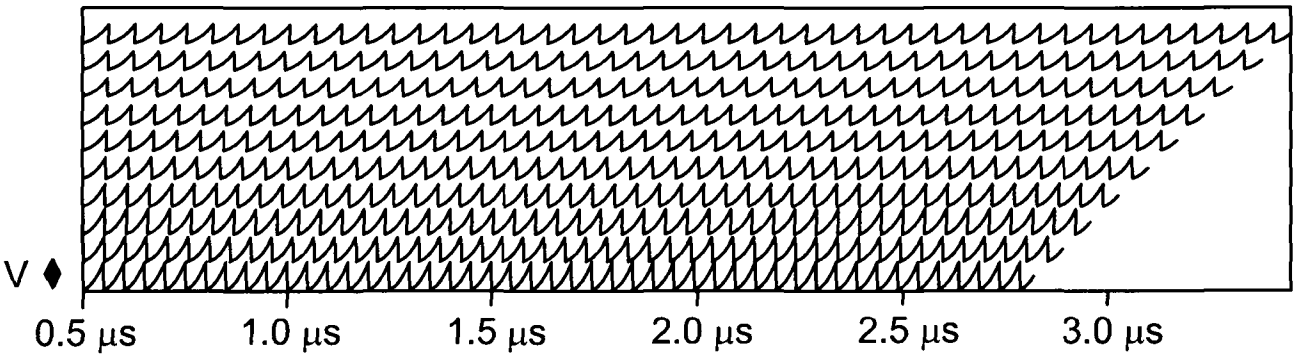
FIG. 7 shows time-varying voltages applied to deflection plates of the apparatus of FIG. 6.

It will be appreciated, however, that the actual throughput may be somewhat less than this, primarily because if more than four ions strike the same pixel within the recording time, the later ions will not be detected. However, this could be improved by including additional counters into each pixel Reference is now made to FIG. 6 which shows the second embodiment of a charged particle spectrum analysis apparatus 50. Similarly to the embodiment shown in FIG. 1, the apparatus comprises a detection portion 15 and a camera 13 (with integral image sensor). However, instead of being converted into a beam of electrons, the ions, emanating from extraction lenses 52, are deflected by a time varying electric field during their transit to the detection portion 15. Because of much higher mass of ions relative to electrons, an arrangement of multiple deflection electrodes 51 with tuned time-varying electric fields is required. The phase difference between the ramp potentials applied to consecutive plates is tuned such that as an ion passes through the apparatus towards the detection portion 15, it 'sees' a constant potential and undergoes a well-defined deflection, in the same way as can be achieved with electrons using a single set of deflection plates. FIG. 7 shows an example of the time-varying potentials, and their phases, for the different electrodes 51.

What is claimed is:

1. A charged particle spectrum analysis apparatus comprising:

a controller comprising a data processor and a memory, wherein the memory comprises instructions for causing the data processor to output control signals, an electric field generator arranged to subject charged particles to a time-varying electric field, and a detector to record charged particle time spectrum data of charged particles which have passed through the electric field, the detector comprising a position-sensitive detection portion, wherein, pursuant to the output control signals from the data processor, the time-varying electric field is activated in synchrony with activation of the detector, and the time-varying electric field subjects a predetermined region of said detection portion to consecutive charged particle deflection cycles, each of said deflection cycles comprising a sweep of deflected charged particles over the predetermined region, and the detector is repeatedly activated in synchrony with the electric field to record the particles of each sweep in a consecutive repeating manner over a single mass spectrum.

2. The apparatus as claimed in claim 1, wherein the electric field generator is arranged to generate a cyclic electric field, the magnitude of which increases with time in each cycle.

3. The apparatus as claimed in claim 2, wherein the electric field generator is arranged to generate a cyclic ramped electric field.

4. The apparatus as claimed in claim 1, wherein the detector comprises an image sensor arranged to record images of distributions of charged particles.

5. The apparatus as claimed in claim 4, wherein the image sensor is arranged to record images of distributions of charged particles impinging on the position-sensitive detection portion.

6. The apparatus as claimed in claim 4, wherein a frame rate of the image sensor is arranged to be in synchrony with the time-varying electric field.

7. The apparatus as claimed in claim 4, wherein a clock rate of the image sensor is arranged to be in synchrony with the time-varying electric field.

8. The apparatus as claimed in claim 1, wherein the electric field generator is arranged such that a deflection imparted by the electric field to the charged particles is in a predetermined direction.

9. The apparatus as claimed in claim 8, wherein the predetermined direction is substantially parallel to a direction of alignment of pixels of an image sensor of the detector.

10. The apparatus as claimed in claim 1, wherein said apparatus is arranged to convert a stream of sample ions into a stream of electrons, and the electric field generator is arranged to subject electrons to the time-varying electric field.

11. The apparatus as claimed in claim 10, further comprising a micro-channel plate arrangement to convert the sample ions into a stream of electrons.

12. The apparatus as claimed in claim 1, wherein the electric field generator is arranged to subject sample ions to a time-varying electric field.

13. The apparatus as claimed in claim 1, wherein said apparatus is a time-of-flight mass spectrometer.

14. A method of charged particle spectrum analysis comprising the steps of:

subjecting charged particles to a time-varying electric field;

activating a detector to record charged particle time spectrum data of the charged particles which have passed through the field; and activating the time-varying electric field in synchrony with the detector, the detector comprising a position-sensitive detection portion;

wherein the time-varying electric field is arranged to subject a predetermined region of said detection portion to consecutive charged particle deflection cycles, wherein each of said deflection cycles comprises a sweep of deflected charged particles over the predetermined region, and wherein the detector is repeatedly activated in synchrony with the electric field to record the particles of each sweep in a consecutive repeating manner, over a single mass spectrum.

* * * * *